US011011362B2

(12) United States Patent
Ugarov

(10) Patent No.: US 11,011,362 B2
(45) Date of Patent: May 18, 2021

(54) FAST CONTINUOUS SRM ACQUISITIONS WITH OR WITHOUT ION TRAPPING

(71) Applicant: Thermo Finnigan LLC, San Jose, CA (US)

(72) Inventor: Mikhail V. Ugarov, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 48 days.

(21) Appl. No.: 16/576,515

(22) Filed: Sep. 19, 2019

(65) Prior Publication Data

US 2021/0090869 A1 Mar. 25, 2021

(51) Int. Cl.

| | |
|---|---|
| ***H01J 49/06*** | (2006.01) |
| ***H01J 49/00*** | (2006.01) |
| ***H01J 49/42*** | (2006.01) |

(52) U.S. Cl.

CPC ..... *H01J 49/061* (2013.01); *H01J 49/0031* (2013.01); *H01J 49/4215* (2013.01)

(58) Field of Classification Search

None

See application file for complete search history.

(56) References Cited

U.S. PATENT DOCUMENTS 7,078,686 B2 * 7/2006 Roushall ..... H01J 49/022 250/282
7,755,036 B2 * 7/2010 Satoh ..... H01J 49/408 250/287
8,368,010 B2 * 2/2013 Kawana ..... H01J 49/4215 250/282
8,604,420 B2 * 12/2013 Kou ..... H01J 49/422 250/282

(Continued)

FOREIGN PATENT DOCUMENTS

EP 3382739 A1 10/2018
EP 3582249 A1 * 12/2019 ..... H01J 49/4215

(Continued)

OTHER PUBLICATIONS

Adamson et al., "An ion mobility mass spectrometer for investigating photoisomerization and photodissociation of molecular ions", Rev. Sci. Instrum. 85, Dec. 31, 2009, (2014).

(Continued)

*Primary Examiner* — Andrew Smyth
(74) *Attorney, Agent, or Firm* — David A. Schell

(57) ABSTRACT

A mass spectrometer includes an ion source, an ion guide, a first gate, first and second mass filters, a fragmentation cell, a detector, and a controller. The ion source is configured to produce an ion beam from a sample. The first and second mass filters are configured to selectively transmit ions within a mass-to-charge range and reject ions outside of the mass-to-charge range. The detector is configured to measure the intensity of the transmitted ion beam. The controller is configured to close the first ion gate to prevent ions from entering the first mass filter, switch a first quadrupole voltage of the first mass filter to a voltage of a first transition, and open the first ion gate to allow ions to enter the first mass filter, the opening offset from the switching by at least the time required to adjust the voltage of the first mass filter.

18 Claims, 11 Drawing Sheets

(56) References Cited

U.S. PATENT DOCUMENTS

| | | | | |
|---|---|---|---|---|
| 8,704,161 | B2 * | 4/2014 | Kawana | H01J 49/0077 250/281 |
| 8,716,659 | B2 * | 5/2014 | Kawana | H01J 49/0077 250/292 |
| 8,859,955 | B2 | 10/2014 | Green | |
| 9,269,551 | B2 * | 2/2016 | Ueda | H01J 49/24 |
| 9,322,814 | B2 * | 4/2016 | Asano | H01J 49/005 |
| 9,646,813 | B2 | 5/2017 | Bateman et al. | |
| 9,685,313 | B2 * | 6/2017 | Bateman | H01J 49/4215 |
| 9,761,432 | B2 * | 9/2017 | Ueda | H01J 49/24 |
| 9,881,781 | B2 | 1/2018 | Green | |
| 9,929,001 | B2 * | 3/2018 | Asano | H01J 49/167 |
| 10,062,557 | B2 | 8/2018 | Kenny | |
| 10,551,347 | B2 | 2/2020 | Hoyes et al. | |
| 10,629,425 | B2 | 4/2020 | Hoyes et al. | |
| 10,679,841 | B2 * | 6/2020 | Oser | H01J 49/429 |
| 2006/0016979 | A1 * | 1/2006 | Yang | H01J 49/4225 250/288 |
| 2006/0016985 | A1 * | 1/2006 | Roushall | H01J 49/022 250/292 |
| 2010/0065731 | A1 * | 3/2010 | Kawana | H01J 49/004 250/281 |
| 2010/0084552 | A1 * | 4/2010 | Kawana | H01J 49/0077 250/288 |
| 2010/0108878 | A1 * | 5/2010 | Bateman | G01N 27/622 250/283 |
| 2010/0108879 | A1 * | 5/2010 | Bateman | G01N 27/622 250/283 |
| 2012/0286148 | A1 * | 11/2012 | Kawana | H01J 49/0077 250/281 |
| 2015/0122985 | A1 * | 5/2015 | Ristroph | H01J 49/0054 250/282 |
| 2015/0268203 | A1 * | 9/2015 | Asano | H01J 49/005 250/288 |
| 2015/0340212 | A1 * | 11/2015 | Ueda | H01J 49/005 250/288 |
| 2016/0343562 | A1 * | 11/2016 | Ueda | H01J 49/24 |
| 2017/0287691 | A1 * | 10/2017 | Asano | G01N 27/62 |
| 2018/0166262 | A1 * | 6/2018 | Moulds | H01J 49/0031 |
| 2019/0385832 | A1 * | 12/2019 | Oser | H01J 49/0031 |

FOREIGN PATENT DOCUMENTS

| | | | | |
|---|---|---|---|---|
| JP | 5083160 | B * | 11/1993 | |
| JP | 2010092630 | A * | 4/2010 | H01J 49/0077 |
| JP | 5083160 | B2 * | 11/2012 | H01J 49/0077 |

OTHER PUBLICATIONS

Agilent Technologies, "Agilent 6400 Series Triple Quadrupole LC/MS System—Concepts Guide", https://www.agilent.com/cs/library/usermanuals/public/G3335-90135_QQQ_Concepts.pdf, Manual, 2012, pp. 1-72.

Dolnikowski et al., "Ion-trapping technique for ion/molecule reaction studies in the center quadrupole of a triple quadrupole mass spectrometer", International Journal of Mass Spectrometry and Ion Processes, vol. 82, Issues 1-2, 1988, pp. 1-15.

* cited by examiner

FAST CONTINUOUS SRM ACQUISITIONS WITH OR WITHOUT ION TRAPPING

FIELD

The present disclosure generally relates to the field of mass spectrometry including fast continuous selected reaction monitoring (SRM) acquisitions with or without ion trapping.

INTRODUCTION

Modern Quantitative analyzers, such as triple quadrupole mass spectrometers, need to measure hundreds of analytes per second eluting from a chromatography separator. Any time required to prepare the instrument for the next transition is a loss to the duty cycle and speed. Usually, major losses come from the time it takes to switch voltages on optical elements, and the time to allow ions to reach appropriate locations along the ion beam path.

Typically, switching times are in the range of 1 to 3 ms, and time of flight of ions in the system is between 0.5 to 2 ms. Thus, to reach current industry standard of 500 transitions (SRMs) per second requires some compromises, and further improvement is needed.

SUMMARY

In a first aspect, a mass spectrometer can include an ion source, an ion guide, a first gate, a first mass filter, a fragmentation cell, a second mass filter, a detector, and a controller. The ion source can be configured to produce an ion beam from a sample. The first mass filter can be configured to selectively transmit ions within a mass-to-charge range and reject ions outside of the mass-to-charge range. The second mass filter can be configured to selectively transmit ions within a mass-to-charge range and reject ions outside of the mass-to-charge range. The detector can be configured to measure the intensity of the transmitted ion beam. The controller can be configured to close the first ion gate to prevent ions from entering the first mass filter; switch a first quadrupole voltage of the first mass filter to a voltage of a first transition; and open the first ion gate to allow ions to enter the first mass filter. The opening can be offset from the switching by a settling time of the first mass filter. The settling time can include the time required to adjust the voltage of the first mass filter.

In various embodiments of the first aspect, switching the first quadrupole voltage can be offset from closing the first gate by a first mass filter flight time. The first mass filter flight time can include the time required for ions entering the first mass filter prior to closing the first gate to exit the first mass filter.

In various embodiments of the first aspect, the controller can be configured to cause the detector to continuously acquire ion intensity measurements In various embodiments of the first aspect, closing the first gate can trap ions in the ion guide.

In various embodiments of the first aspect, the controller can be further configured to switch a collision cell collision energy to a collision energy for the first transition, switching the collision energy can be offset in time from switching the first quadrupole voltage by an amount of time not greater than a time it takes for ions entering the first mass filter to exit the first mass filter. In particular embodiments, switching the collision energy can be offset by an amount of time not less than a settling time of the first mass filter or an opening time of the first gate.

In various embodiments of the first aspect, the controller can be further configured to switch a second quadrupole voltage of a second mass filter to a voltage of the first transition, switching the second quadrupole voltage can be offset in time from switching the first quadrupole voltage by an amount of time not greater than a time it takes for ions entering the first mass filter to exit the collision cell. In particular embodiments, switching second mass filter voltage can be offset by an amount of time not less than a settling time of the first mass filter or an opening time of the first gate.

In various embodiments of the first aspect, the controller can be further configured to switch a detector gain to a gain for the first transition, switching the detector gain can be offset in time from switching the first quadrupole voltage by an amount of time not greater than a time it takes for ions entering the first mass filter to exit the second mass filter. In particular embodiments, switching the detector gain can be offset by an amount of time not less than a settling time of the first mass filter or an opening time of the first gate.

In various embodiments of the first aspect, the controller can be further configured to switch the first quadrupole voltage of a first mass filter to a voltage of a second transition after an amount of time not less than the time it takes for ions entering the first mass filter to exit the first mass filter and closing the first ion gate to prevent ions from entering the first mass filter during a settling time.

In various embodiments of the first aspect, the mass spectrometer can further comprising a second gate located between the fragmentation cell and the second mass filter. In particular embodiments, the controller can be further configured to close the second ion gate to prevent ions from entering the second mass filter during a second settling time, the second settling time including the time required to adjust the voltage of the second mass filter. In particular embodiments, switching the second quadrupole voltage can be offset from closing the second ion gate by a second mass filter flight time, the second mass filter flight time including the time required for ions entering the second mass filter prior to closing the second gate to exit the second mass filter. In further embodiments, closing the second gate can trap ions in the fragmentation cell.

In a second aspect, a method can include closing a first ion gate to prevent ions from entering a first quadrupole; switching a first quadrupole voltage of the first quadrupole to a voltage of a first transition; opening the first ion gate to allow ions to enter the first quadrupole, the opening can be offset from the switching by a settling time of the first mass filter, the settling time can include the time required to adjust the voltage of the first mass filter; switching a collision cell collision energy to a collision energy for the first transition, switching the collision energy offset in time from switching the first quadrupole voltage by an amount of time not greater than a time it takes for ions entering the first quadrupole to exit the first quadrupole; switching a second quadrupole voltage of a second quadrupole to a voltage of the first transition, switching the second quadrupole voltage offset in time from switching the first quadrupole voltage by an amount of time not greater than a time it takes for ions entering the first quadrupole to exit the collision cell; switching a detector gain to a gain for the first transition, switching the second quadrupole voltage offset in time from switching the first quadrupole voltage by an amount of time not greater than a time it takes for ions entering the first quadrupole to exit the second quadrupole; and closing the first ion gate to prevent ions from entering the quadrupole after an amount of time not less than the time it takes for ions entering the first quadrupole to exit the first quadrupole and switching the first quadrupole voltage of the first quadrupole to a voltage of a second transition.

In various embodiments of the second aspect, switching of the first quadrupole voltage can be offset from the closing by a first mass filter flight time including the time required for ions entering the first mass prior to closing the first gate to exit the first mass filter.

In various embodiments of the second aspect, the method can further include closing a second ion gate to prevent ions from entering the second quadrupole during a second settling time, the second settling time can include the time required to adjust the voltage of the second quadrupole. In particular embodiments, switching the second quadrupole voltage can be offset from the closing the second ion gate by a second mass filter flight time, the second mass filter flight time including the time required for ions entering the second quadrupole prior to closing the second gate to exit the second quadrupole.

In various embodiments of the second aspect, the method can further include ionizing a sample to form an ion beam.

In various embodiments of the second aspect, the method can further include detecting the intensity of the ion beam. In particular embodiments, detecting the intensity of the ion beam can be continuous.

In various embodiments of the second aspect, switching the collision energy can be offset by an amount of time not less than a settling time of the first quadrupole or an opening time of the first gate.

In various embodiments of the second aspect, switching the second quadrupole voltage can be offset by an amount of time not less than a settling time of the first quadrupole or an opening time of the first gate.

In various embodiments of the second aspect, switching the detector gain can be offset by an amount of time not less than a settling time of the first quadrupole or an opening time of the first gate.

In a third aspect, a method can include closing a first ion gate to prevent ions from entering the first quadrupole and trap the ions in an ion guide; switching a first quadrupole voltage of a first quadrupole to a voltage of a first transition and, wherein the trapping of ions is correlated with the change in the first quadrupole voltage; opening the first ion gate after a settling time to allow the ions to enter the first quadrupole; the settling time including the time required to adjust the voltage of the first quadrupole; switching a collision cell collision energy to a collision energy for the first transition, switching the collision energy offset in time from switching the first quadrupole voltage by an amount of time not greater than a time it takes for ions entering the first quadrupole to exit the first quadrupole; switching a second quadrupole voltage of a second quadrupole to a voltage of the first transition, switching the second quadrupole voltage offset in time from switching the first quadrupole voltage by an amount of time not greater than a time it takes for ions entering the first quadrupole to exit the collision cell; switching a detector gain to a gain for the first transition; switching the second quadrupole voltage offset in time from switching the first quadrupole voltage by an amount of time not greater than a time it takes for ions entering the first quadrupole to exit the second quadrupole; and closing the first ion gate to prevent ions from entering the first quadrupole after an amount of time not less than the time it takes for ions entering the first quadrupole to exit the first quadrupole and switching the first quadrupole voltage of a first quadrupole to a voltage of a second transition.

In various embodiments of the third aspect, switching the first quadrupole voltage can be offset from closing the first gate by a first mass filter flight time, the first mass filter flight time can include the time required for ions entering the first quadrupole prior to closing the first gate to exit the first quadrupole.

In various embodiments of the third aspect, the trapping of ions can occur only during the settling time.

In various embodiments of the third aspect, there can be a substantially continuous stream of ions entering the first quadrupole between switching the first quadrupole voltage to the voltage of the first transition and switching the first quadrupole voltage to the voltage of the second transition.

In various embodiments of the third aspect, the method can further include closing a second ion gate to prevent ions from entering the second quadrupole during a second settling time, the second settling time can include the time required to adjust the voltage of the second quadrupole. In particular embodiments, switching the second quadrupole voltage can be offset from the closing the second ion gate by a second mass filter flight time, the second mass filter flight time including the time required for ions entering the second quadrupole prior to closing the second gate to exit the second quadrupole.

In various embodiments of the third aspect, the method can include ionizing a sample to form an ion beam.

In various embodiments of the third aspect, the method can further include detecting the intensity of the ion beam. In particular embodiments, detecting the intensity of the ion beam can be continuous.

In various embodiments of the third aspect, switching the collision energy can be offset by an amount of time not less than a settling time of the first quadrupole or an opening time of the first gate.

In various embodiments of the third aspect, switching second quadrupole voltage can be offset by an amount of time not less than a settling time of the first quadrupole or an opening time of the first gate.

In various embodiments of the third aspect, switching the detector gain can be offset by an amount of time not less than a settling time of the first quadrupole or an opening time of the first gate.

DRAWINGS

For a more complete understanding of the principles disclosed herein, and the advantages thereof, reference is now made to the following descriptions taken in conjunction with the accompanying drawings, in which.

FIGS. 5, 6, 7, and 8 are timing diagrams illustrating the operation of a triple quadrupole, in accordance with various embodiments.

Figure 9:
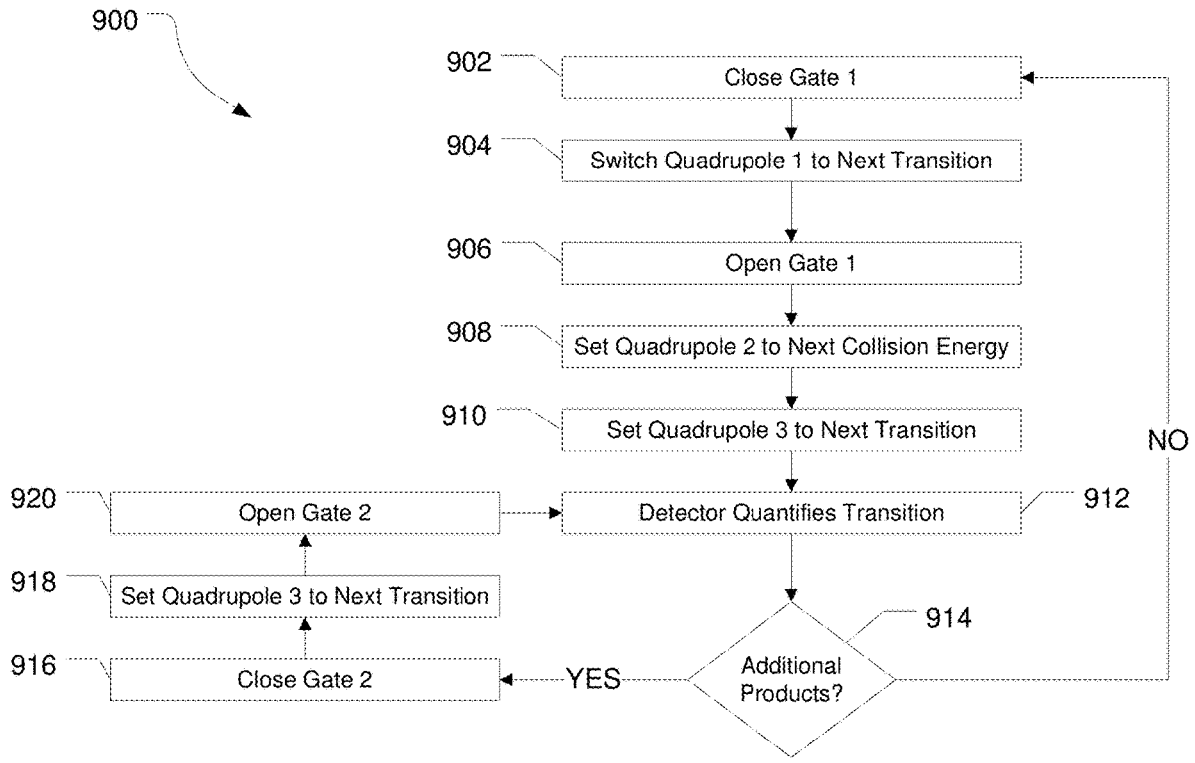

FIG. 9 is a flow diagram illustrating an exemplary method of operating a triple quadrupole, in accordance with various embodiments.

Figure 10:
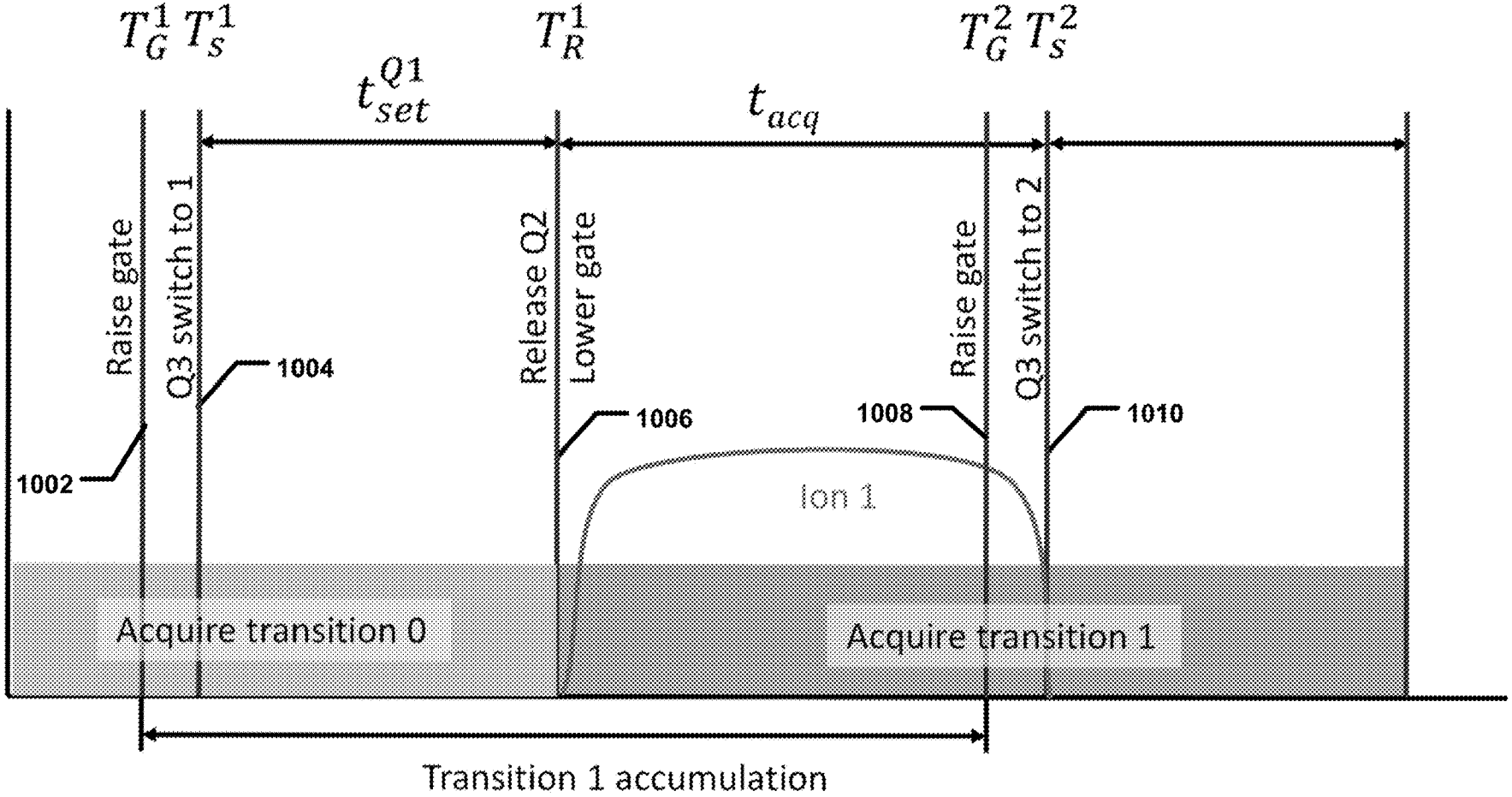

FIG. 10 are timing diagrams illustrating the operation of a triple quadrupole, in accordance with various embodiments.

Figure 11:
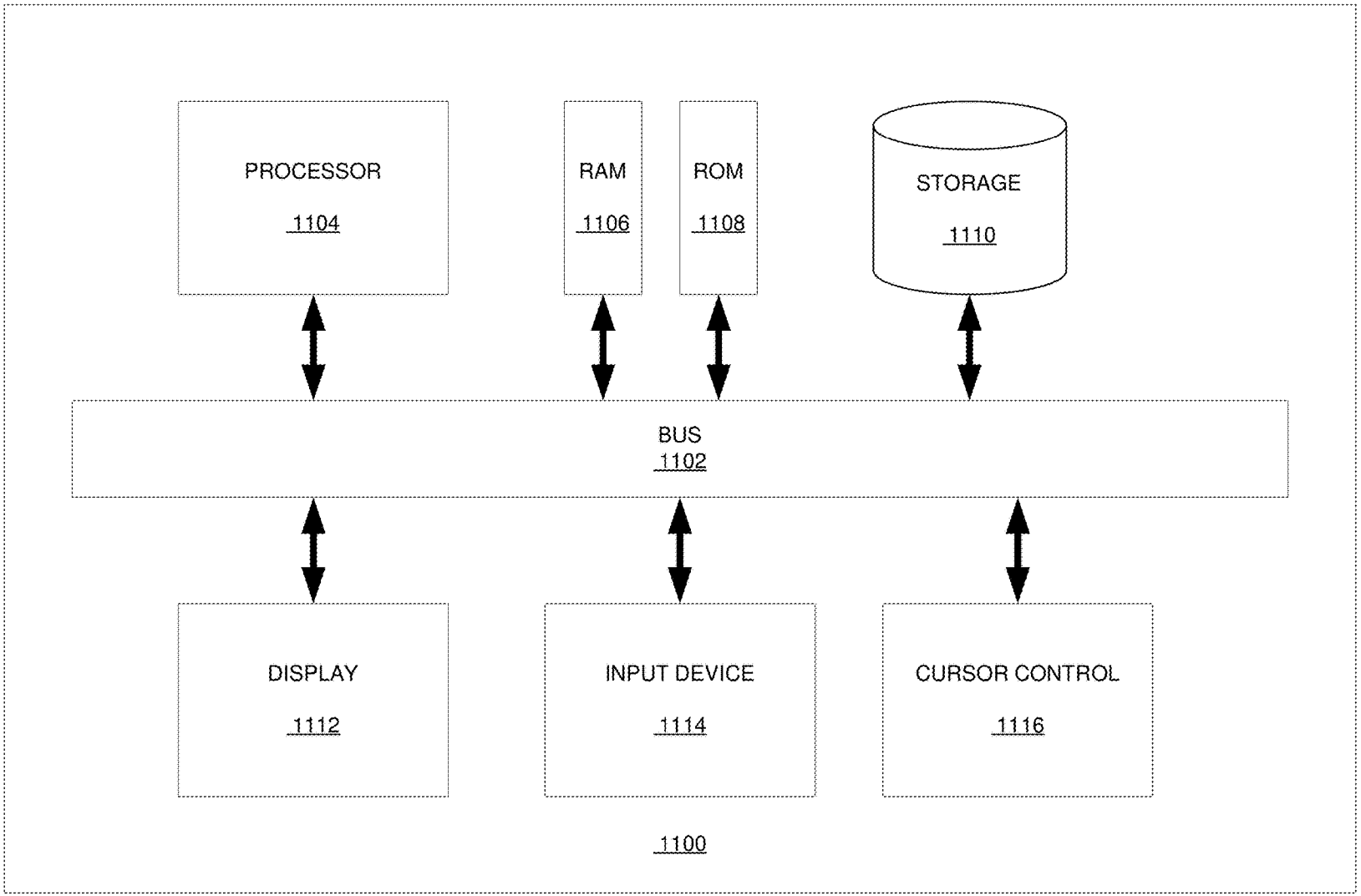

FIG. 11 is a block diagram illustrating an exemplary data analysis system, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods for ion separation are described herein.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Mass Spectrometry Platforms

Figure 1:
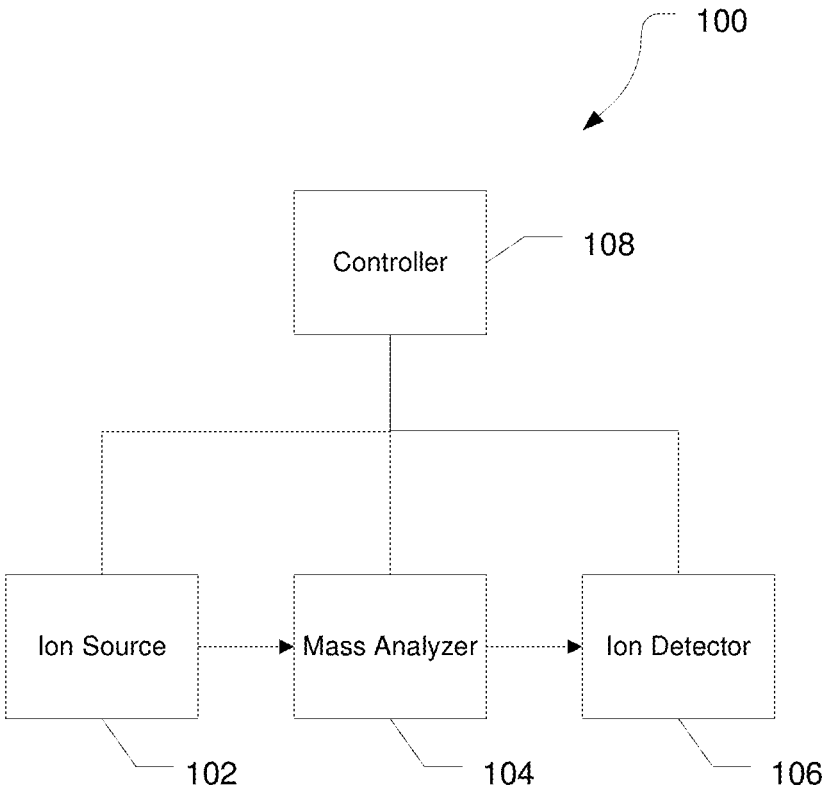
FIG. 1 is a block diagram of an exemplary mass spectrometry system, in accordance with various embodiments.

Various embodiments of mass spectrometry platform 100 can include components as displayed in the block diagram of FIG. 1. In various embodiments, elements of FIG. 1 can be incorporated into mass spectrometry platform 100. According to various embodiments, mass spectrometer 100 can include an ion source 102, a mass analyzer 104, an ion detector 106, and a controller 108.

In various embodiments, the ion source 102 generates a plurality of ions from a sample. The ion source can include, but is not limited to, a matrix assisted laser desorption/ionization (MALDI) source, electrospray ionization (ESI) source, atmospheric pressure chemical ionization (APCI) source, atmospheric pressure photoionization source (APPI), inductively coupled plasma (ICP) source, electron ionization source, chemical ionization source, photoionization source, glow discharge ionization source, thermospray ionization source, and the like.

In various embodiments, the mass analyzer 104 can separate ions based on a mass-to-charge ratio of the ions. For example, the mass analyzer 104 can include a quadrupole mass filter analyzer, a quadrupole ion trap analyzer, a time-of-flight (TOF) analyzer, an electrostatic trap (e.g., Orbitrap) mass analyzer, Fourier transform ion cyclotron resonance (FT-ICR) mass analyzer, and the like. In various embodiments, the mass analyzer 104 can also be configured to fragment the ions using collision induced dissociation (CID) electron transfer dissociation (ETD), electron capture dissociation (ECD), photo induced dissociation (PID), surface induced dissociation (SID), and the like, and further separate the fragmented ions based on the mass-to-charge ratio.

In various embodiments, the ion detector 106 can detect ions. For example, the ion detector 106 can include an electron multiplier, a Faraday cup, and the like. Ions leaving the mass analyzer can be detected by the ion detector. In various embodiments, the ion detector can be quantitative, such that an accurate count of the ions can be determined.

In various embodiments, the controller 108 can communicate with the ion source 102, the mass analyzer 104, and the ion detector 106. For example, the controller 108 can configure the ion source or enable/disable the ion source. Additionally, the controller 108 can configure the mass analyzer 104 to select a particular mass range to detect. Further, the controller 108 can adjust the sensitivity of the ion detector 106, such as by adjusting the gain. Additionally, the controller 108 can adjust the polarity of the ion detector 106 based on the polarity of the ions being detected. For example, the ion detector 106 can be configured to detect positive ions or be configured to detected negative ions.

High Duty Cycle Srm

Several approaches have been suggested to improve timing and duty cycle. In one of them, continuous acquisition without waiting (settling) time is proposed (Waters U.S. Pat. No. 8,859,955B2) while the switching of elements is essentially asynchronous to acquisition of specific SRMs. In this method, the difficulty comes with a need to distinguish signals from two adjacent transitions which can often overlap.

In another approach (Waters U.S. Ser. No. 10/062,557B2), switching of elements starts before the acquisition ends. This allows recovery of a portion of ions that still travel through the device after the switch. However, the duty cycle is not fully recovered, and some prior knowledge or calculation of time of flight of all ions in all conditions is required.

Yet in another approach by Jeol (U.S. Pat. No. 8,604,420B2), uses repeated storage and pulsing of ions into the quadrupole mass filters. This can avoid transmitting ions through the quadrupole while voltages are changing. However, this prior art does not teach time exact coordination between switching times with "ion pulsing" that is necessary to maximize duty cycle and minimize number of trapped ions. It also does not describe the option of discarding ions by the gate operation.

Figure 2:
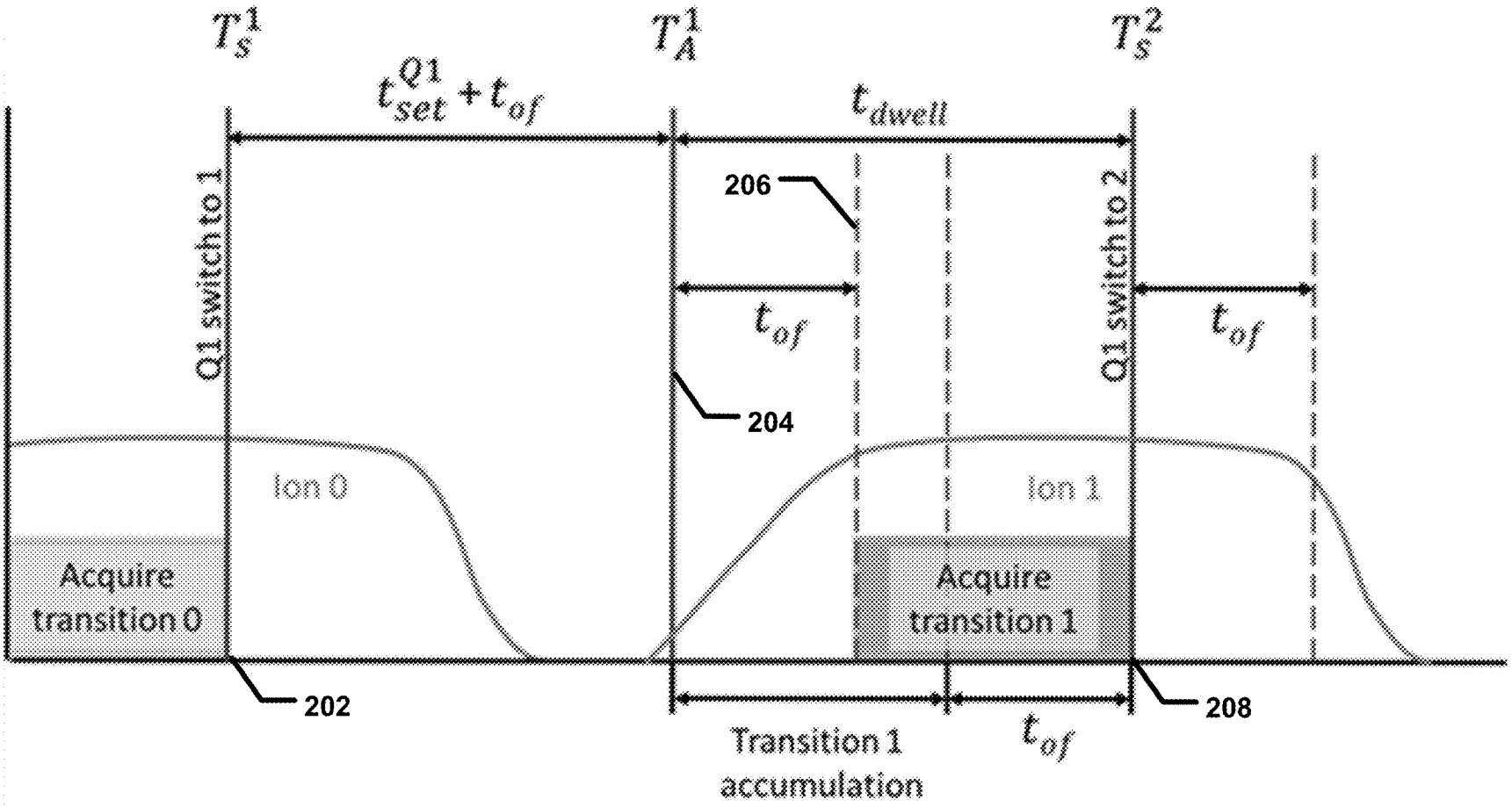
FIG. 2 is a timing diagram illustrating the operation of a triple quadrupole, in accordance with various embodiments.

FIG. 2 illustrates typical operation of a triple quadrupole. At 202, the voltages on Quadrupole 1 can be switched to a first transition. When a precursor switching occurs, there may be no acquisition while voltages on the Quadrupole 1 (and other associated optics) are settling ($t_{set}^{Q1}$), and ions of the second type travel to the detector ($t_{of}$). During the settling time, the voltages on Quadrupole 1 can be in flux, and thus Quadrupole 1 may not effectively isolate the precursor ions of transition 1. Once the voltages have stabilized at 204, it can be necessary to wait for the ions to travel to the detector. At 206, the acquisition can begin and can occur over the duration of the dwell time ($t_{dwell}$). At 208, the voltages on Quadrupole 1 can be switched to a second transition, terminating the acquisition of transition 1. If dwell time is short then the duty cycle can be low as a large portion of time is lost waiting. In addition, when a switch to the next precursor occurs, a large fraction of the current precursor ions may not be detected, as they (or, rather, their fragments) need certain time to reach the detector ($t_{of}$).

Figure 3:
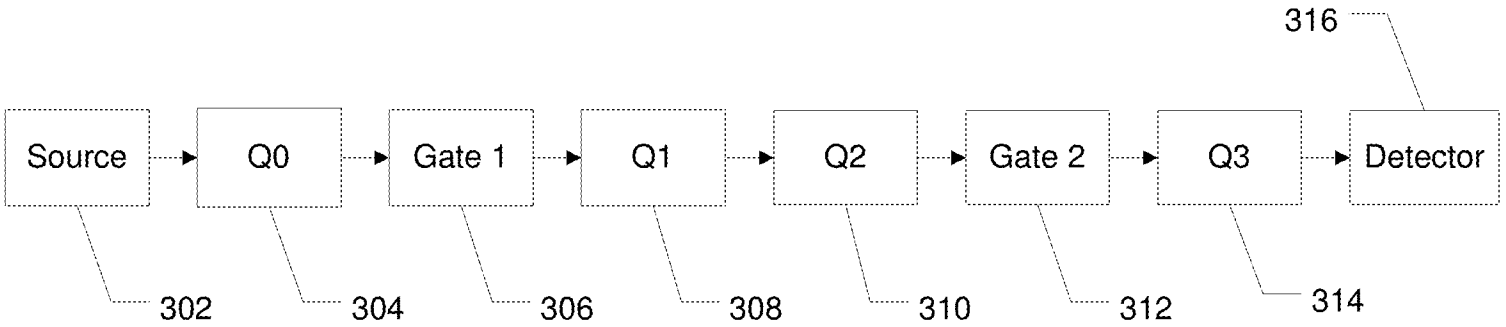
FIG. 3 is a block diagram illustrating an exemplary triple quadrupole, in accordance with various embodiments.

FIG. 3 shows the general structure of a Triple Quadrupole Mass Spectrometer 300. The Triple Quadrupole Mass Spectrometer can include a source 302, a multipole 304, a gate 306, quadrupoles 308 and 310, a gate 312, quadrupole 314, and detector 316. Source 302 can be similar to source 102 in FIG. 1 and detector 316 can be similar to detector 106 in FIG. 1.

Multipole 304 functions as an ion guide. Quadrupoles 308 and 314 can function as mass filters, and quadrupole 312 can function as a fragmentation cell by colliding the ions with a gas such that energy from the collisions can result in fragmentation of precursor ions. In addition to traditional elements, the gates 306 and 312 located at the entrance to quadrupoles 308 and 314 can be used to transmit ions through, block/reject them, or accumulate them for subsequent injection down the path. The key requirement for the Gates is the ability to switch between modes much faster than the quadrupole switching time (t<<1 ms).

In various embodiments, the ion guides 304 and 310 can be used to trap ions when gates 306 or 312 are closed.

There can be four main benefits to the disclosed device and methods. The first one assures that the calculated ion intensity is always representative of the ion signal for confident quantitation. This can be a challenge when electronics are being switched, and ion beams take some time to fully establish themselves. Thus, for a certain amount of time, the signal intensity can be below (or, rarely, above) the expected normal level, which can lead to incorrect intensity calculation. For the correct result, the full number of ions entering the MS should be measured, and the time interval of their entry should also be known precisely.

Second, it is beneficial to have continuous data acquisition as opposed to having to stop and restart acquiring data for different SRM transitions. This can reduce overhead time for setting up digital detection system for the next ion. Additionally, since the acquisition is continuous, the burden of determining which time interval of the acquired data corresponds to which ion can be shifted to post-processing if necessary. In various embodiments, the data acquisition can be continuous throughout a run, especially continuous between one closing of the first gate and another closing of the first gate. That is, detecting the intensity of the ion beam can include continuously acquiring ion intensity measurements between a first closing of the first gate and a second closing of the first gate, and even throughout a run without having gaps between transitions.

Third, the ions entering MS during the time of switching of different devices (mainly, Q1, Q2 and Q3) is typically wasted and is referred to as "settling time" when no acquisition occurs. It is possible to avoid duty cycle losses by trapping ions at the entrance to the quadrupoles, and, in best case, increase duty cycle up to 100%. An additional benefit from high duty cycle is the increased switching frequency that could allow for SRM speeds of up to 1000 $s^{-1}$ or higher.

Fourth, the use of input gates to the quadrupoles highly reduces likelihood of overlapping signals from different transitions on the detector, which removes concern about channel cross-talk, and, again, allows pushing the duty cycle to approximately 100%.

Figure 4:
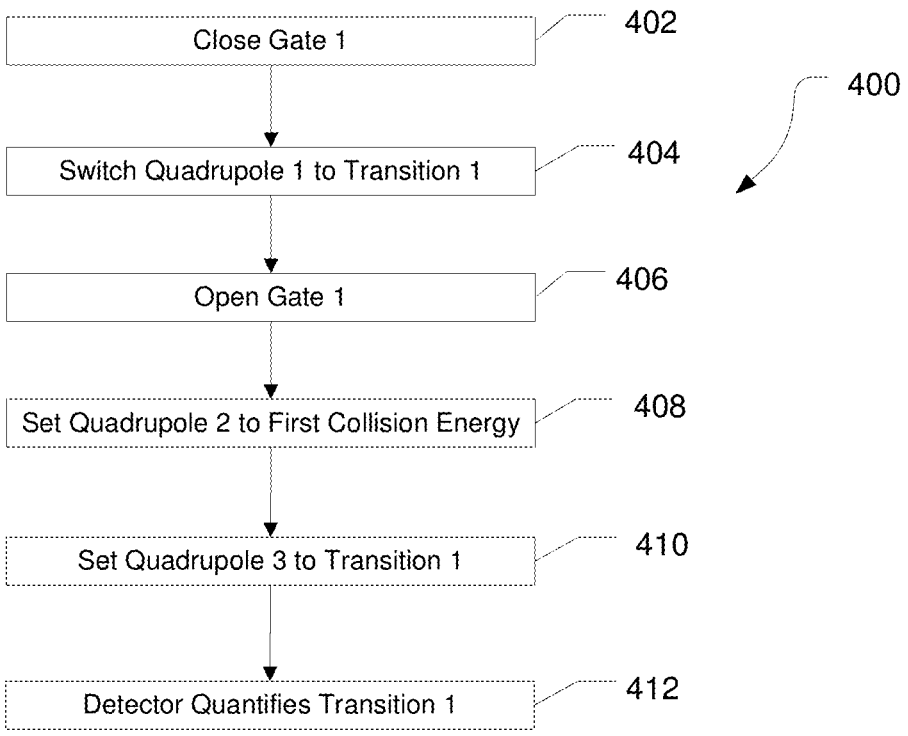
FIG. 4 is a flow diagram illustrating an exemplary method of operating a triple quadrupole, in accordance with various embodiments.

FIG. 4 is a flow diagram illustrates a method 400 of operating a triple quadrupole using a gate before the Q1 to improve the utilization. At 402, gate 1 can be closed to prevent ions from entering quadrupole 1, and at 404 quadrupole 1 can be switched to transition 1. In various embodiments, sufficient time can be allowed for ions that entered quadrupole 1 prior to gate 1 closing to exit quadrupole 1 prior to switching quadrupole 1. If ions are still in quadrupole 1 as the voltages are switched, ions of unknown mass-to-charge ratio may traverse quadrupole 1. Specifically, since the voltages/amplitudes are moving between the transition 0 and transition 1, any ions that make it through the quadrupole may not belong to the transition 0 or to transition 1. Since the detection is continuous, these unknown ions may be detected as part of the trailing edge of the previous transition and cause an error in the integration of the ion intensity.

After the voltages have stabilized in quadrupole 1, the gate can be opened, as indicated at 406. At 408, quadrupole 2 can be set to the collision energy for transition 1, and at 410, quadrupole 3 can be set to transition 1. The switch of quadrupole 2 and 3 can be timed to allow ions that exited quadrupole 1 prior the switch of quadrupole 1 to travel along the path to the detector, allowing a greater portion of the time to be devoted to acquisition. If quadrupole 2 and quadrupole 3 are switched concurrently with quadrupole 1, all the ions along the path would need to be discarded and the entire duration of $t_o$f would be lost. At 412, the detector quantifies transition 1.

In various embodiments, closing the gate at 402 can cause ions arriving at the gate to be discarded while the trap is closed. Ions arriving at the gate when the gate is opened at 406 can pass through the gate and enter quadrupole 1. In other embodiments, closing the gate at 402 can trap ions in a multipole/ion guide upstream of the gate. When the gate is opened at 406, the trapped ions can be released into quadrupole 1.

Figure 5:
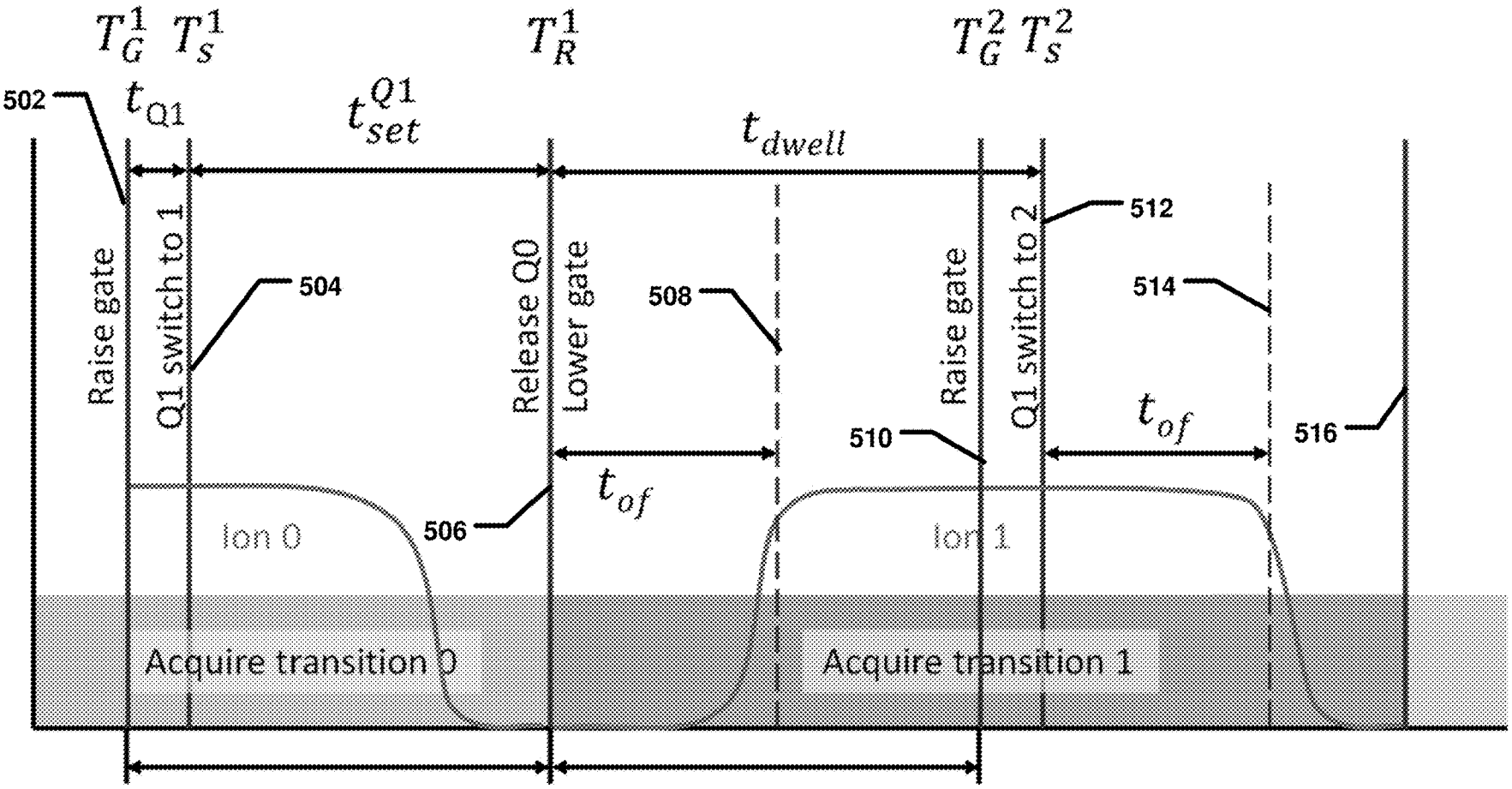

FIG. 5 is a timing diagram illustrating method 400. At 502, gate 1 can be closed to prevent ions from entering Q1. Closing the gate can substantially prevent ions from traversing Q1 during the settling time while the voltages are in flux and may allow ions of different m/z to pass through Q1. At 504, after a delay $t_{Q1}$ corresponding to the time it takes for ions to already in Q1 to exit Q1, Q1 can be switched to transition 1. After the settling ($t_{set}^{Q1}$), gate 1 is lowered to allow ions to enter Q1, as shown at 506. Additionally, Q2 Collision Energy and Q3 voltages can be set to the transition 1. By offsetting the switch of Q2 and Q3 from the switch of Q1, ions that had traversed Q1 at time 502 can continue along the path to the detector providing an extended acquisition time.

Also at 506, the detector can begin acquisition of data for transition 1. When $t_{set}^{Q1}>t_{of}$, ions from transition 0 will reach the detector during the period of time gate 1 is closed. Additionally, ions are unable to enter Q1 until the gate 1 opens. Thus, there is a gap in time equivalent to $t_{set}^{Q1}$ between the last ions from transition 0 reaching the detector and the first ions from transition 1 reaching the detector. At 508, after the travel time to the detector ($t_{of}$), ions that first entered Q1 at 506 can reach the detector. At 510, gate 1 can again be closed to prevent ions from entering Q1, and at 512, Q1 can be switched to transition 2. By 514 the packet of ions has largely arrived to the detector. Acquisition can continue to 516 while ions that had already entered Q1 prior to closing the gate can continue to travel to the detector. At 516, the gate can be opened and analysis of transition 2 can begin. In various embodiments, the system can integrate the ion intensity from 506 to 516 in quantifying the compound corresponding to transition 1.

The operation of the gate can allow continuous acquisition by the detector so that the only ions that are not detected are the ions arriving to Q1 when the gate is closed during the Q1 settling time. Compared to the conventional operation shown in FIG. 2, ions loss due to finite time-of-flight to the detector is avoided, duty cycle is improved and higher SRM speed can be achieved.

The scheme in FIG. 5 assumes that $t_{set}^{Q1}>t_{of}$ in which case the flux of the ions from transition 0 stops before the detection of the transition 1 starts at $T_R^1$. In some embodiments, the time-of-flight is particularly long and $t_{of}>t_{set}^{Q1}$ resulting in ions from the prior transition reaching the detector after the gate is opened. This can be addressed by two different means. First, $t_{of}$ can be reduced by speeding up ions through the system with stronger axial fields. The second approach lies purely in the domain of data processing and executes the appropriate shift of the time interval where the signal for the corresponding transition is assigned (see FIG. 6). The adjusted timing for the ion signal is shown there in blue color. This can be done either in real-time or post-processing.

Figure 6:
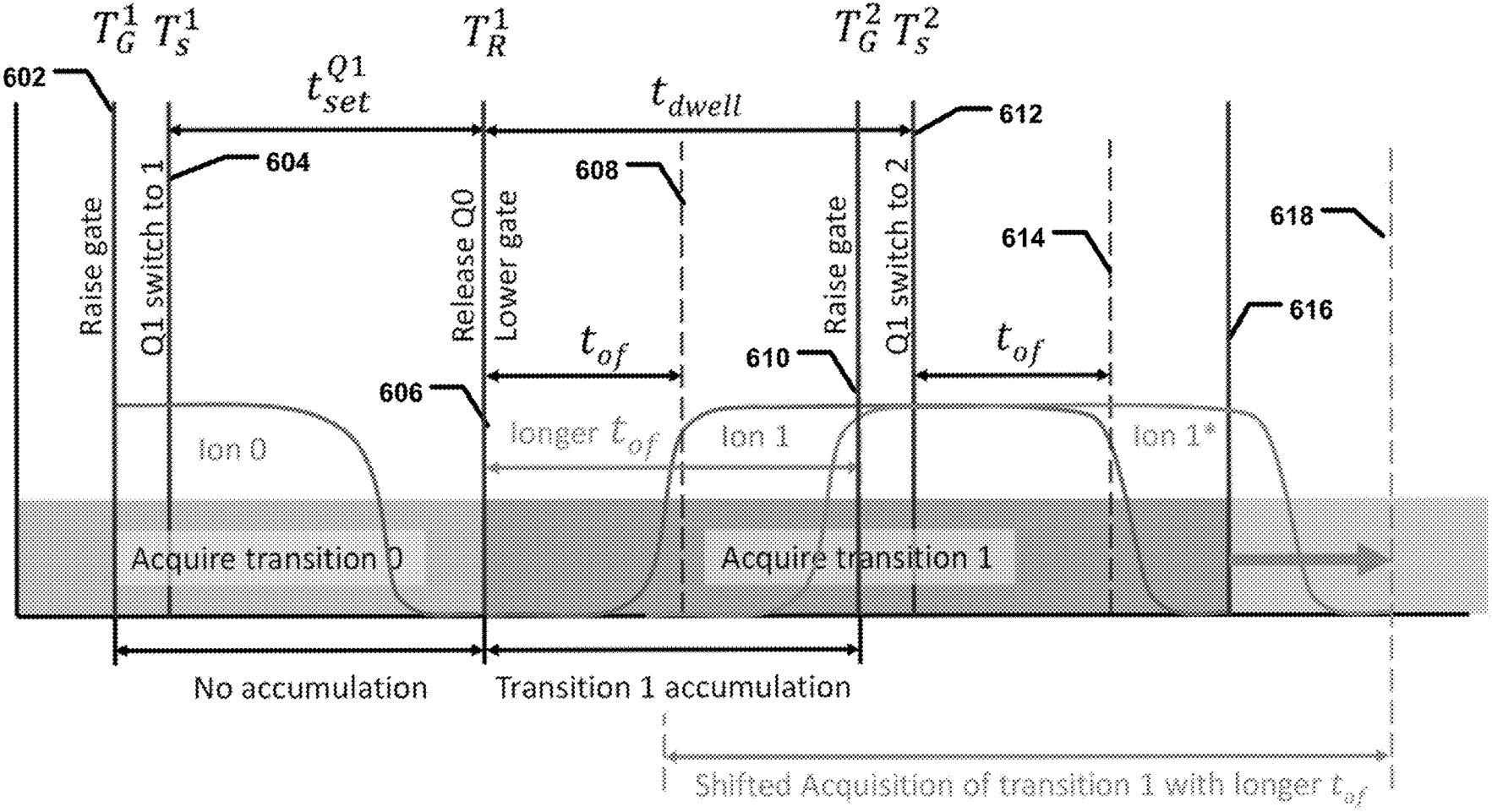

As with FIG. 5, FIG. 6 is a timing diagram similar to FIG. 5 except $t_{of}>t_{set}^{Q1}$. At 602, gate 1 can be closed. At 604, after a delay $t_{Q1}$ corresponding to the time it takes for ions to already in Q1 to exit Q1, Q1 can be switched to transition 1. After the settling ($t_{set}^{Q1}$), gate 1 is lowered to allow ions to enter Q1, as shown at 606. Q2 Collision Energy and Q3 voltages can be set to the transition 1, and the detector can begin acquisition for transition 1. However, with $t_{of}>t_{set}^{Q1}$, ions of transition 1 can be delayed in reaching the detector and the ions may not reach the detector until 608 rather than at 606. At 610, gate 1 can again be closed to prevent ions from entering Q1, and, at 612, Q1 can be switched to transition 2. Additionally, instead of the ions from transition 1 stopping at 614, the ion flow from transition 1 can continue past the time when the gate is opened at 616. Since acquisition is continuous throughout the process, the delay in ion arrival can be accounted for by shifting the acquisition time by the appropriate amount to account for transition 1 ions until 618. The shift can be calibrated or calculated based on the known properties of the system.

Figure 7:
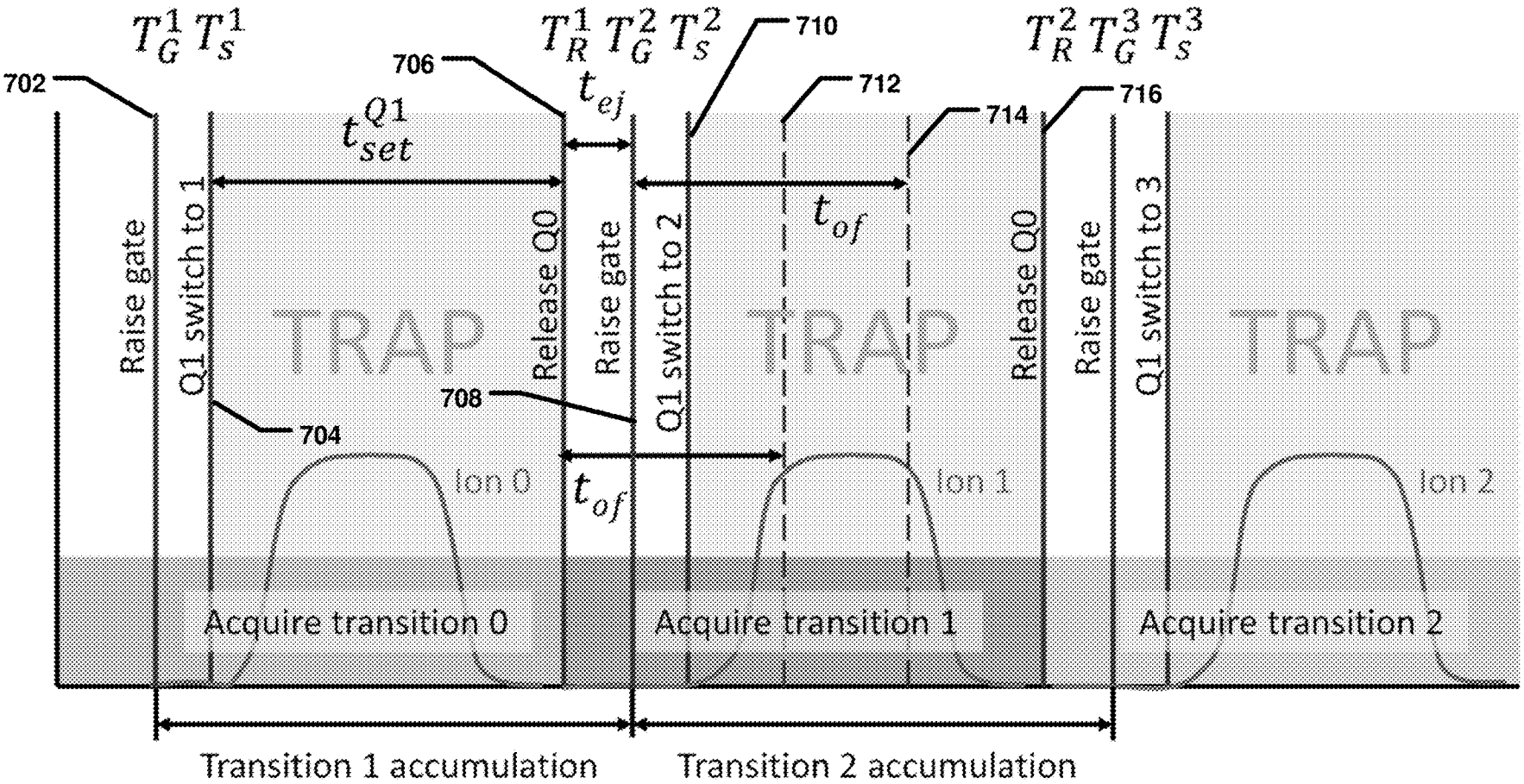

While the approach described in FIGS. 4 through 6 helps improve the duty cycle, even better gains can be achieved if storage (trapping) of ions is used. FIG. 7 shows a timing diagram when trapping of ions in Q0 occurs during the time gate 1 is closed.

At 702, gate 1 can be closed to start accumulating ions in Q0. At 704, after a delay allowing for ions to already in Q1 to exit Q1, Q1 can be switched to transition 1. At 706, gate 1 can be opened to allow the ions trapped in Q0 to enter Q1. Additionally, Q2 Collision Energy and Q3 voltages can be set to the transition 1, and the detector can begin acquisition of data for transition 1. At 708, after sufficient time for ejection of the ions from Q0 into Q1, the gate can be closed. At 710, after a delay allowing for ions to already in Q1 to exit Q1, Q1 can be switched to transition 2. During the settling time for transition 2, the ions of transition 1 can be detected (largely between 712 and 714) and integrated for the entire interval between 706 and 716. At 716, the gate can be opened for transition 2.

Compared to the scheme in FIG. 5, the time interval $t_{ej}$ between 706 and 708 can be selected in a way to allow the ions trapped in Q0 to enter Q1. Because of stopping and releasing ions, the ion peak profile on the detector can be narrower in the time domain which can substantially eliminate the possibility of cross-talk. However, the number of the ions detected represents the full amount of time $t_{set}^{Q1}+t_{ej}$ due to trapping the ions for the duration of $t_{set}^{Q1}$. This can lead to duty cycle of about 100% and potentially very fast SRM speed.

As a practical example, if $t_{set}^{Q1}+t_{ej}$ is under 2 ms then over 500 unique precursor transitions can be acquired per second. This is a considerably improvement over the current state of the art.

Figure 8:
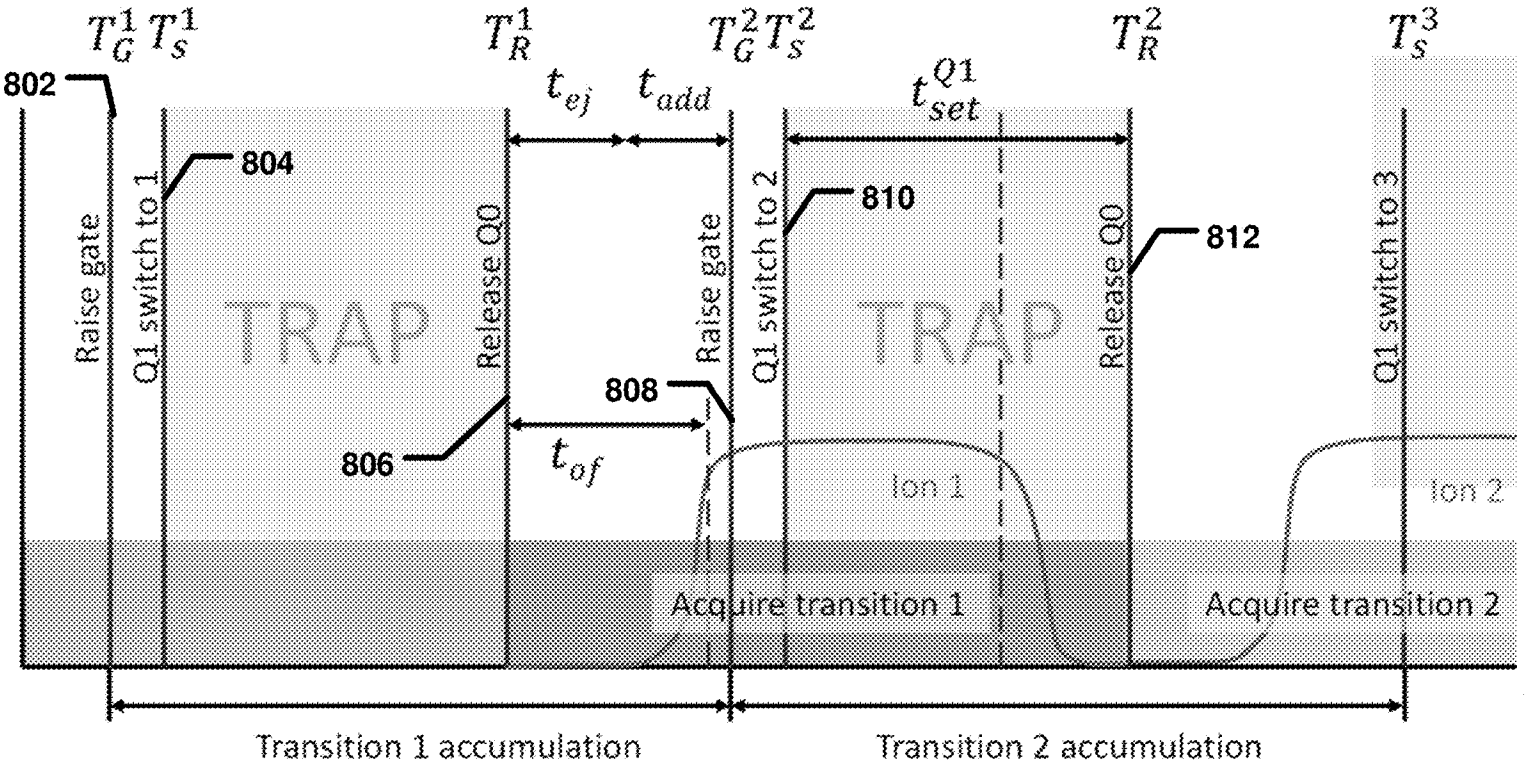

The approach shown in FIG. 7 corresponds to the shortest effective dwell time possible. If a method can have longer dwell time for transitions, an additional time $t_{add}$ can be used to extend the time between subsequent trapping events as shown in FIG. 8. The additional benefit of this approach is in the fact that it can work for both short and long dwell times. Since trapping period is short and fixed, there is little risk of overfilling Q0 charge capacity.

At 802, gate 1 can be closed to start accumulating ions in Q0. After allowing for ions already in Q1 to exit Q1, Q1 can be switched to transition 1 at 804. At 806, gate 1 can be opened to allow the ions trapped in Q0 to enter Q1. Additionally, Q2 Collision Energy and Q3 voltages can be set to the transition 1, and the detector can begin acquisition of data for transition 1. In this particular case of a longer dwell time the gate can be closed at a later time of 808 and Q1 can be switched to transition 2 at 810. This extends the open gate period by taxa. During the settling time for transition 2, the ions of transition 1 can be detected and integrated between 806 and 812. At 812, the gate can be opened for transition 2.

FIG. 9 is a flow diagram illustrating a method 900 of operating a triple quadrupole using a gate before the Q1 and a gate before Q3 to improve the utilization. At 902, gate 1 can be closed to prevent ions from entering quadrupole 1, and at 904 quadrupole 1 can be switched to select the precursor ion of the next transition to select the precursor ion. After the voltages have stabilized in quadrupole 1, the gate can be opened, as indicated at 906.

At 908, quadrupole 2 can be set to the collision energy for transition 1, and at 910, quadrupole 3 can be set to select the product ion of the next transition. The switch of quadrupole 2 and 3 can be timed to allow ions that exited quadrupole 1 prior the switch of quadrupole 1 to travel along the path to the detector, allowing a greater portion of the time to be devoted to acquisition. If quadrupole 2 and quadrupole 3 are switched concurrently with quadrupole 1, all the ions along the path would need to be discarded and the entire duration of $t_{oF}$ would be lost.

At 912, the detector quantifies the transition. At 914, it can be determined if there are additional product ions using the same precursor ion (or a precursor ion of similar m/z). If there are additional transitions with the same precursor m/z range, gate 2 can be closed, as indicated at 916. At 918, quadrupole 3 can be set to selected the product ion of the next transition and, at 920, gate 2 can be opened after the voltages on quadrupole 3 have settled. The method then returns to 912 for quantification of the transition.

When no additional product ions are selected for the same precursor m/z range, the method can return to 902 for selection of another precursor.

In various embodiments, ions arriving at gate 1 or gate 2 can be discarded when the gate is closed. Ions arriving at gate 1 or gate 2 when the gate is opened can pass through the gate to subsequent quadrupoles. In other embodiments, closing gate 1 or gate 2 can be cause ions to be trapped upstream of the gate. The trapped ions can be released when the gate is opened. When trapping ions, ions can be sent as packets with higher intensity than the ion stream as the target ions are accumulated over time and released together. In trapping mode, it can be necessary to return to 902 from 914 even if there are multiple target product ions for a single parent ion.

In various embodiments, the collision energy can be changed between a first product ion to a second product ion of the same parent ion, such as at 918. When that occurs, it can be necessary to ensure gate 2 is closed long enough for the collision energy to change and ions entering quadrupole 2 prior to the collision energy settling to be discarded.

FIG. 10 provides a timing illustration when only Q3 is switched in case of multiple products for the same precursor. Normally, the switching time is again lost from total acquisition time. However, in this case, at 1002, Gate 2 can be closed to start accumulating ions in Q2, and, after sufficient time for ions in Q3 to exit Q3, Q3 can be switched to transition 1 at 1004. After Q3 voltages are settled at 1006, Gate 2 can be opened to allow ions to enter Q3 and the detection system can starts to quantify the transition 1. At 1008, Gate 2 can be closed to start accumulating ions in Q2, and Q3 can be switched to transition 2 at 1010.

Similar to the previous cases, a duty cycle up to the 100% can be achieved. In this estimate, an obvious omission of time-of-flight from Q3 to the detector is done, however, that would only alter the situation to a small degree, as this particular $t_{of}$ is relatively short compared to the overall $t_{of}$ through Q1, Q2, and Q3.

Computer-Implemented System

FIG. 11 is a block diagram that illustrates a computer system 1100, upon which embodiments of the present teachings may be implemented as which may incorporate or communicate with a system controller, for example controller 108 shown in FIG. 1, such that the operation of components of the associated mass spectrometer may be adjusted in accordance with calculations or determinations made by computer system 1100. In various embodiments, computer system 1100 can include a bus 1102 or other communication mechanism for communicating information, and a processor 1104 coupled with bus 1102 for processing information. In various embodiments, computer system 1100 can also include a memory 1106, which can be a random access memory (RAM) or other dynamic storage device, coupled to bus 1102, and instructions to be executed by processor 1104. Memory 1106 also can be used for storing temporary variables or other intermediate information during execution of instructions to be executed by processor 1104. In various embodiments, computer system 1100 can further include a read only memory (ROM) 1108 or other static storage device coupled to bus 1102 for storing static information and instructions for processor 1104. A storage device 1110, such as a magnetic disk or optical disk, can be provided and coupled to bus 1102 for storing information and instructions.

In various embodiments, computer system 1100 can be coupled via bus 1102 to a display 1112, such as a cathode ray tube (CRT) or liquid crystal display (LCD), for displaying information to a computer user. An input device 1114, including alphanumeric and other keys, can be coupled to bus 1102 for communicating information and command selections to processor 1104. Another type of user input device is a cursor control 1116, such as a mouse, a trackball or cursor direction keys for communicating direction information and command selections to processor 1104 and for controlling cursor movement on display 1112. This input device typically has two degrees of freedom in two axes, a first axis (i.e., x) and a second axis (i.e., y), that allows the device to specify positions in a plane.

A computer system 1100 can perform the present teachings. Consistent with certain implementations of the present teachings, results can be provided by computer system 1100 in response to processor 1104 executing one or more sequences of one or more instructions contained in memory 1106. Such instructions can be read into memory 1106 from another computer-readable medium, such as storage device 1110. Execution of the sequences of instructions contained in memory 1106 can cause processor 1104 to perform the processes described herein. In various embodiments, instructions in the memory can sequence the use of various combinations of logic gates available within the processor to perform the processes describe herein. Alternatively hard-wired circuitry can be used in place of or in combination with software instructions to implement the present teachings. In various embodiments, the hard-wired circuitry can include the necessary logic gates, operated in the necessary sequence to perform the processes described herein. Thus implementations of the present teachings are not limited to any specific combination of hardware circuitry and software.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A mass spectrometer comprising:

an ion source configured to produce an ion beam from a sample, an ion guide;

a first ion gate;

a first mass filter configured to selectively transmit ions within a mass-to-charge range and reject ions outside of the mass-to-charge range;

a fragmentation cell;

a second mass filter configured to selectively transmit ions within a mass-to-charge range and reject ions outside of the mass-to-charge range;

a detector configured to measure the intensity of the transmitted ion beam; and a controller configured to:

close the first ion gate to prevent ions from entering the first mass filter;

switch a first quadrupole voltage of the first mass filter to a voltage of a first transition; and open the first ion gate to allow ions to enter the first mass filter, the opening offset from the switching by a settling time of the first mass filter, the settling time including the time required to adjust the voltage of the first mass filter;

wherein the controller is further configured to switch a fragmentation cell collision energy to a collision energy for the first transition, switching the collision energy is offset in time from switching the first quadrupole voltage by an amount of time not greater than a time it takes for ions entering the first mass filter to exit the first mass filter.

2. The mass spectrometer of claim 1, wherein switching the first quadrupole voltage is offset from closing the first ion gate by a first mass filter flight time, the first mass filter flight time including the time required for ions entering the first mass filter prior to closing the first ion gate to exit the first mass filter.

3. The mass spectrometer of claim 1, wherein the controller is further configured to cause the detector to continuously acquire ion intensity measurements.

4. The mass spectrometer of claim 1, wherein closing the first ion gate traps ions in the ion guide.

5. The mass spectrometer of claim 1, wherein the controller is further configured to switch a second quadrupole voltage of a second mass filter to a voltage of the first transition, switching the second quadrupole voltage is offset in time from switching the first quadrupole voltage by an amount of time not greater than a time it takes for ions entering the first mass filter to exit the collision cell.

6. The mass spectrometer of claim 1, wherein the controller is further configured to switch the first quadrupole voltage of a first mass filter to a voltage of a second transition after an amount of time not less than the time it takes for ions entering the first mass filter to exit the first mass filter and closing the first ion gate to prevent ions from entering the first mass filter during the settling time.

7. The mass spectrometer of claim 1, further comprising a second ion gate between the fragmentation cell and the second mass filter.

8. The mass spectrometer of claim 7, wherein the controller is further configured to close the second ion gate to prevent ions from entering the second mass filter during a second settling time, the second settling time including the time required to adjust the voltage of the second mass filter.

9. The mass spectrometer of claim 8, wherein switching the second quadrupole voltage is offset from closing the second ion gate by a second mass filter flight time, the second mass filter flight time including the time required for ions entering the second mass filter prior to closing the second ion gate to exit the second mass filter.

10. The mass spectrometer of claim 8, wherein closing the second ion gate traps ions in the fragmentation cell.

11. A mass spectrometer comprising:

an ion source configured to produce an ion beam from a sample, an ion guide;

a first ion gate;

a first mass filter configured to selectively transmit ions within a mass-to-charge range and reject ions outside of the mass-to-charge range;

a fragmentation cell;

a second mass filter configured to selectively transmit ions within a mass-to-charge range and reject ions outside of the mass-to-charge range;

a detector configured to measure the intensity of the transmitted ion beam; and a controller configured to:

close the first ion gate to prevent ions from entering the first mass filter;

switch a first quadrupole voltage of the first mass filter to a voltage of a first transition; and open the first ion gate to allow ions to enter the first mass filter, the opening offset from the switching by a settling time of the first mass filter, the settling time including the time required to adjust the voltage of the first mass;

wherein the controller is further configured to switch a detector gain to a gain for the first transition, switching the second quadrupole voltage is offset in time from switching the first quadrupole voltage by an amount of time not greater than a time it takes for ions entering the first mass filter to exit the second mass filter.

12. The mass spectrometer of claim 11, wherein switching the detector gain is offset by an amount of time not less than a settling time of the first mass filter or an opening time of the first ion gate.

13. A method comprising:

closing a first ion gate to prevent ions from entering a first quadrupole;

switching a first quadrupole voltage of the first quadrupole to a voltage of a first transition;

opening the first ion gate to allow ions to enter the first quadrupole, the opening offset from the switching by a settling time of the first mass filter, the settling time including the time required to adjust the voltage of the first mass filter;

switching a collision cell collision energy to a collision energy for the first transition, switching the collision energy offset in time from switching the first quadrupole voltage by an amount of time not greater than a time it takes for ions entering the first quadrupole to exit the first quadrupole;

switching a second quadrupole voltage of a second quadrupole to a voltage of the first transition, switching the second quadrupole voltage offset in time from switching the first quadrupole voltage by an amount of time not greater than a time it takes for ions entering the first quadrupole to exit the collision cell;

switching a detector gain to a gain for the first transition, switching the second quadrupole voltage offset in time from switching the first quadrupole voltage by an amount of time not greater than a time it takes for ions entering the first quadrupole to exit the second quadrupole; and closing the first ion gate to prevent ions from entering the quadrupole after an amount of time not less than the time it takes for ions entering the first quadrupole to exit the first quadrupole and switching the first quadrupole voltage of the first quadrupole to a voltage of a second transition.

14. The method of claim 13, wherein switching of the first quadrupole voltage is offset from closing the first ion gate by a first mass filter flight time including the time required for ions entering the first mass prior to closing the first ion gate to exit the first mass filter.

15. The method of claim 13, further comprising closing a second ion gate to prevent ions from entering the second quadrupole during a second settling time, the second settling time including the time required to adjust the voltage of the second quadrupole.

16. The method of claim 15, wherein switching the second quadrupole voltage is offset from the closing the second ion gate by a second mass filter flight time, the second mass filter flight time including the time required for ions entering the second quadrupole prior to closing the second ion gate to exit the second quadrupole.

17. The method of claim 13, wherein switching the collision energy is offset by an amount of time not less than a settling time of the first quadrupole or an opening time of the first ion gate.

18. The method of claim 13, wherein switching the detector gain is offset by an amount of time not less than a settling time of the first quadrupole or an opening time of the first ion gate.

* * * * *